United States Patent [19]

Jenkins

[11] 3,989,122

[45] Nov. 2, 1976

[54] FOLDING LADDER FOR TRUCK MOUNTED LOADER

[75] Inventor: Richard A. Jenkins, Wilson, N.C.

[73] Assignee: Omark Industries, Inc., Portland, Oreg.

[22] Filed: Oct. 23, 1975

[21] Appl. No.: 624,874

[52] U.S. Cl. ..... 182/84; 182/96; 182/127; 182/159

[51] Int. Cl.[2] ..... E06C 5/24

[58] Field of Search ..... 182/84, 85, 86, 90, 182/91, 95, 96, 159, 160, 115, 127, 116; 280/163, 166

[56] References Cited

UNITED STATES PATENTS

| | | | |
|---|---|---|---|
| 350,047 | 9/1886 | Dunn | 182/160 |
| 1,232,221 | 7/1917 | Chesebro | 182/160 |
| 3,439,776 | 4/1969 | Scheerer | 182/160 |
| 3,656,578 | 4/1972 | Hemken | 182/97 |

*Primary Examiner*—Reinaldo P. Machado
*Attorney, Agent, or Firm*—Robert L. Harrington

[57] ABSTRACT

A loader having an elevated operator's platform mounted behind the cab of a truck. A ladder positioned to the side of the loader enables an operator to climb up to and down from the platform. The ladder includes a first standard fixed to the truck and/or loader, and a second standard carried by the first standard through interconnecting rungs normally spaced from the first standard outwardly of the acceptable travelling width of the truck. The outer standard and interconnecting rungs are pivotally connected to each other and to the inner standard whereby the outer standard can be pivoted upwardly against the inner standard to substantially reduce the width of the ladder to a position within the acceptable travelling width of the truck.

1 Claim, 4 Drawing Figures

FOLDING LADDER FOR TRUCK MOUNTED LOADER

HISTORY OF INVENTION

This invention relates to a ladder used by the operator of a truck-mounted hydraulic loader to climb up to and down from an elevated operator's platform. More specifically, the invention provides a ladder that meets both safety standards and road width requirements without interfering with the truck's load capacity.

It is common for trucks that are used for hauling various materials to be provided with a hydraulic loader. Such a loader is adapted to fit in as small a space as possible, generally behind the truck cab, to maximize the truck's hauling capacity. For loading convenience, the operator of the loader is normally positioned on a platform substantially raised above the truck bed where he has maximum vision. Whereas the operator has previously been left to his own devices for reaching this platform, or perhaps been provided with less than adequate footholds, present day safety standards dictate that a ladder be provided to enable the operator to reach this platform. This ladder is required to have a specific width and run spacing, e.g. the rungs must by 16 inches wide and located 12 inches apart. In that the loader is sandwiched between the load and the cab, the ladder must be located on the side of the loader. It either extends outwardly relative to the load and cab creating overall width problems (a truck travelling the highway cannot be over a certain width) or it extends lengthwise along the truck bed and interferes with the load carrying capacity.

The present invention is believed to satisfy established safety standards while maximizing load capacity and without exceeding road width requirements. In the preferred embodiment, the ladder includes a first standard that attached at its top to the operator's platform and at the bottom to a brace extending from the truck bed. This standard is positioned well within the width requirements of most highway codes. The rungs are pivotally attached to the first standard at spaced positions along the first standard and can be swung upwardly against the standard. This first standard is U-shaped in cross section and one end of each rung is pivotally connected to the legs of the U. The rung can thus be swung up into the channel between the legs of the U to effectively fold the rung inside the standard. A second standard is pivotally connected to the rungs at spacings equal to that of the first standard. The second standard is also U-shaped so that the rungs and second standard will fold upwardly with respect to the first standard in a manner whereby this second standard is folded against the first standard forming an encasement around the rungs. Locking means are provided to prevent unfolding until desired and a brace is provided to brace the ladder in its unfolded position suitable for supporting the operator in climbing up to the platform.

The invention will be further understood by reference to the following detailed description and drawings wherein.

Figure 1:
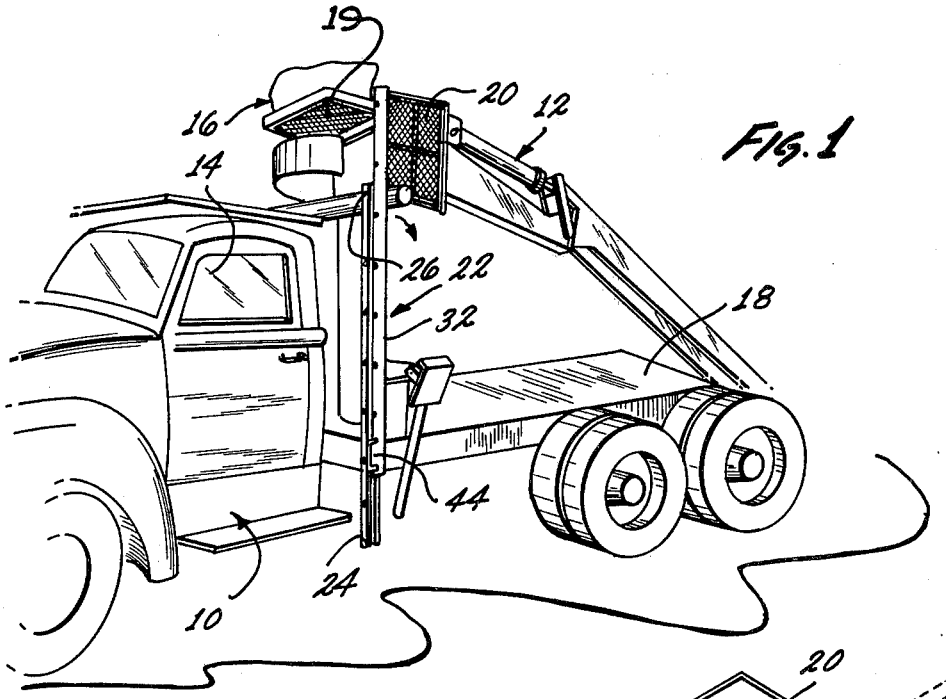
FIG. 1 is a perspective view illustrating a truck mounted loader incorporating a ladder in accordance with the present invention.

Referring to the drawings, a truck 10 has a hydraulic loader 12 mounted directly behind the truck cab 14. The loader controls 16 are elevated above the truck bed 18 where an operator positioned on a platform 19 (generally seated in a specially mounted chair that is not shown) can maneuver the loader to load logs or the like onto the truck bed. It will be understood that the truck driver, who is normally also the loader operator, drives his truck to a storage area, e.g. a log pile, gets out of the truck cab, mounts the operator's platform 19, maneuvers the loader to load logs onto the truck bed, returns to the truck cab, drives the truck to a specified destination, climbs back out of the cab to the operator's platform, unloads the load, returns to the cab and drives back to the storage area. The driver-operator climbs to the platform 19 by climbing up the ladder 22 to the sub platform 20 which provides easy access and mounting on the platform 19.

Figure 4:
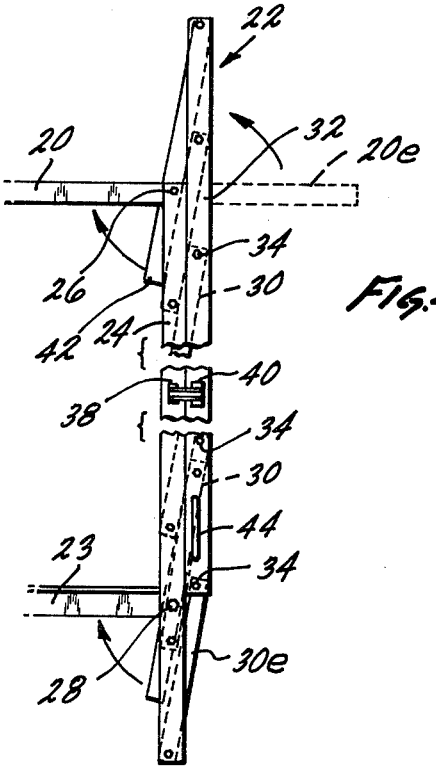
FIG. 4 is a front view of the ladder of FIG. 2 but showing the ladder folded in solid lines.

It will be understood from the introductory portion that the ladder presents a problem for the manufacturer. Highway codes dictate the allowable width of the truck when travelling on the highway. This width is generally just enough to accommodate the width of the truck cab and truck bed. To mount the ladder sideways, i.e. flat against the truck bed, is unacceptable because it interferes with loading. Whereas this interference can be minimized by making the ladder very narrow, established safety standards dictate that such narrow ladders are inadequate. Thus the present ladder is designed to extend sideways as shown in FIG. 2, for use by the operator during loading and unloading stops, but is folded against the truck as shown in FIGS. 1 and 4 (and in dotted lines in FIG. 2) when the truck is made travel ready.

Figure 3:
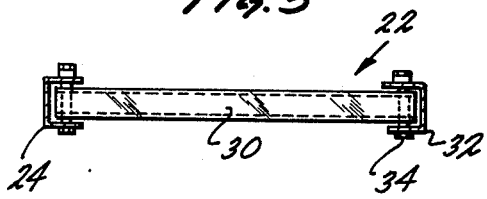
FIG. 3 is a sectional view taken on lines 3—3 of FIG. 2.
Figure 2:
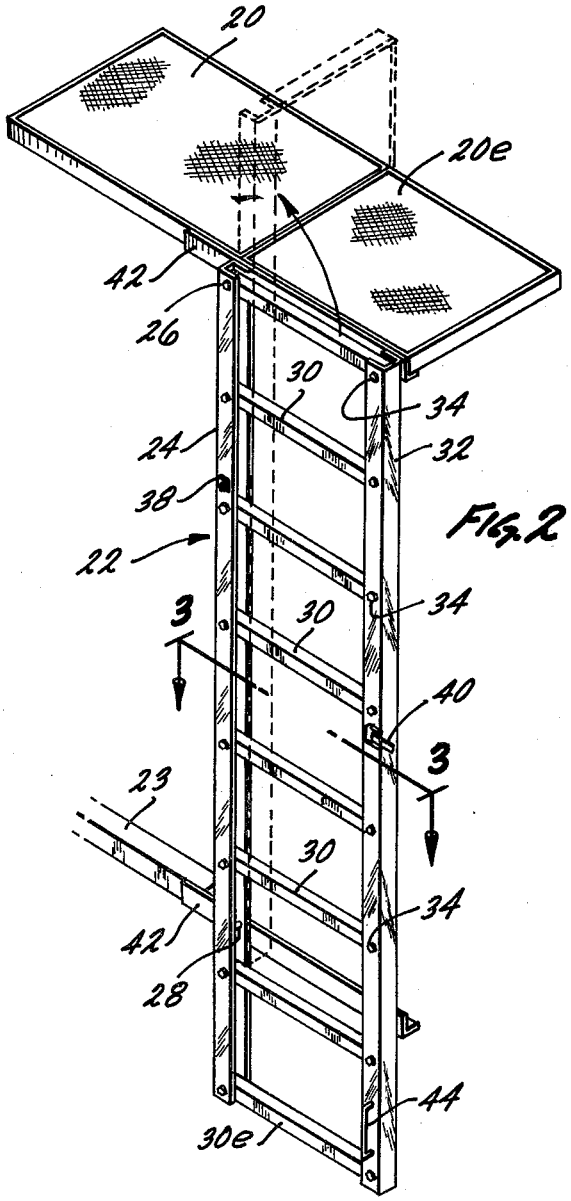
FIG. 2 is an enlarged perspective view of the ladder of FIG. 1, but shown in solid lines in its unfolded and ready to use position and in dotted lines in the folded and travel-ready position.

Referring to FIG. 2, it will be understood that the platform 20 and brace 23 are fastened securely to the truck and loader frame. An inside standard 24 is fastened at its upper end by bolt 26 to the platform 20 and at its lower end by bolt 28 to the brace 23. Rungs 30 are pivotally connected to the inside standard 24 at about 12 inch intervals, the rungs being about 16 inches wide as dictated by the safety standards. An outside standard 32 is designed to parallel the inside standard 24 spaced therefrom by the 16 inch rungs 30. The rungs 30 are connected pivotally to the standard 32 in a manner and at spaced intervals similar to the connections to the standard 32. These connections are shown in more detail in FIG. 3. As shown, the standards, are U-shaped in cross section with the ends of the rungs 30 fitting between the legs of the U and a pivot pin 34 passing through the rungs and the legs of the U.

An extension **20*e* of the main platform 20 is pivotally connected at one end to the main platform 20 and at the other end to the outer standard 32. As shown in dotted lines in FIG. 2 by reason of the pivoted connections of the platform extension 20*e* and the rungs 30 to the standards 24 and 32, the outer standard with the rungs 30 and platform extension 20*e* can be pivoted upwardly in a folding motion to reduce the width of the ladder from the 16 plus inches to about four inches, i.e. the combined width of the two standards (see also FIG. 4). The rungs 30 being narrower than the distance between the legs of the U-shaped standard in effect fold inside the standards as shown. The platform extension also folds upwardly as shown. The two standards are locked together in the travel ready, i.e. folded position by the interengagement of the hook 30 on standard 24 and clasp 40 on standard 32. In its unfolded position, the standard 32 and rungs 30 are located and fixed in the extended position by support lugs 42 which are rigidly attached at the extreme top of the ladder, i.e. to the platform extension 20***e* and near the bottom of the ladder as shown. These support lugs 42 engage the underside of the main platform 20 and brace 23 at the point of full extension. A handle 44 is provided on the outer standard 32 to aid the operator in folding and unfolding the ladder.

Whereas the preferred embodiment of the invention is illustrated in the foregoing, it will be understood that numerous variations and modifications will be obvious to those skilled in the art without departing from the invention, the scope of which is defined in the claims appended hereto.

What I claim is:

1. A truck mounted loader having an elevated platform and including a foldable ladder comprising; a truck frame, a first standard fixed to the truck frame with its upper end adjacent to the platform, a plurality of rungs pivotally connected at one end to the first standard, a second standard pivotally connected to the other end of each rung, brace means for bracing the rungs and second standard in an extended position with the rungs perpendicular to the first and second standards, said brace means permitting the second standard and rungs to be folded upwardly about the pivotal connection with the first standard to fold said rungs and second standard against the first standard to reduce the width of the ladder, and said elevated platform having a stationary portion and an extended portion with one end of the extended portion pivotally connected to said stationary portion and the other end attached to the second standard whereby said extended portion is folded upwardly about its pivotal connection with the stationary portion when the second standard is folded against the first standard.

* * * * *